US007083004B2

(12) United States Patent
Roodenburg et al.

(10) Patent No.: US 7,083,004 B2
(45) **Date of Patent: *Aug. 1, 2006**

(54) CANTILEVERED MULTI PURPOSE TOWER AND METHOD FOR INSTALLING DRILLING EQUIPMENT

(75) Inventors: Joop Roodenburg, Delft (NL); Pieter Dirk Melis Van Duivendijk, Utrecht (NL)

(73) Assignee: Itrec B.V., Schiedam (NL)

( * ) Notice: Subject to any disclaimer, the term of this patent is extended or adjusted under 35 U.S.C. 154(b) by 212 days.

This patent is subject to a terminal disclaimer.

(21) Appl. No.: 10/685,981

(22) Filed: Oct. 15, 2003

(65) Prior Publication Data

US 2004/0151549 A1 Aug. 5, 2004

Related U.S. Application Data

(60) Provisional application No. 60/419,128, filed on Oct. 17, 2002.

(51) Int. Cl.
*E21B 15/02* (2006.01)

(52) U.S. Cl. ..... 175/5; 166/366; 405/201

(58) Field of Classification Search ..... 166/335, 166/366, 244.1, 52, 75.11, 105.5; 405/196, 405/201; 414/22.51, 22.63; 175/5
See application file for complete search history.

(56) References Cited

U.S. PATENT DOCUMENTS

| | | | | |
|---|---|---|---|---|
| 3,658,298 A | | 4/1972 | Moore | 254/190 |
| 3,714,995 A | | 2/1973 | Hanes | 175/5 |
| 3,791,628 A | | 2/1974 | Burns | 254/172 |
| 3,804,183 A | | 4/1974 | Duncan | 175/5 |
| 3,917,230 A | | 11/1975 | Barron | 254/173 |
| 3,918,379 A | | 11/1975 | McNary | 114/264 |
| 3,949,693 A | | 4/1976 | Bauer | 114/265 |
| 4,423,994 A | | 1/1984 | Schefers | 414/22 |
| 4,620,692 A | | 11/1986 | Foreman | 254/277 |
| 4,688,764 A | | 8/1987 | Nayler | 254/277 |
| 4,744,710 A | * | 5/1988 | Reed | 414/22.63 |
| 4,867,418 A | | 9/1989 | Daniels | 254/277 |
| 5,139,367 A | * | 8/1992 | Ingle | 405/201 |
| 5,492,436 A | * | 2/1996 | Suksumake | 405/201 |
| 5,855,455 A | * | 1/1999 | Williford et al. | 405/196 |
| 5,894,895 A | | 4/1999 | Welsh | 175/5 |
| 6,269,880 B1 | * | 8/2001 | Landry | 166/105.5 |
| 6,729,804 B1 | * | 5/2004 | Roodenburg et al. | 405/201 |

FOREIGN PATENT DOCUMENTS

| | | |
|---|---|---|
| GB | 2087342 | 4/1981 |
| GB | 2171974 A | 3/1986 |
| NL | 1009043 | 4/1998 |
| WO | WO 9911518 | 8/1998 |

* cited by examiner

*Primary Examiner*—Jennifer H. Gay
*Assistant Examiner*—Matthew J. Smith
(74) *Attorney, Agent, or Firm*—Buskop Law Group,. P.C.; Wendy Buskop

(57) ABSTRACT

A drilling rig having a deck capable of being used offshore and a method for commissioning a well using the drilling rig and a method for decommissioning a well using the drilling rig, wherein the drilling rig comprises: a cantilever which is mounted so as to be moveable in a first direction and a second direction; a Multi Purpose Tower mounted on the cantilever; a supporting cart disposed between the cantilever and the deck which in turn is movably fixed on the deck of the drilling rig; at least two friction reducing devices attached to the supporting cart; and wherein the cantilever can slide relative to the drilling platform.

32 Claims, 20 Drawing Sheets

CANTILEVERED MULTI PURPOSE TOWER AND METHOD FOR INSTALLING DRILLING EQUIPMENT

CROSS REFERENCE TO RELATED APPLICATIONS

This application claims priority to U.S. patent application Ser. No. 60/419,128, filed Oct. 17, 2002 and U.S. patent application Ser. No. 10/225,770, filed Aug. 22, 2002, Pat. No. 6,729,804, issued 4 May 2004 both of which are incorporated herein.

FIELD OF THE INVENTION

The invention relates to a drilling rig for use in the offshore industry in the form of a Jack Up platform, Tension Leg, Compliant Tower, Mono Hull Ship or Semi-Submersible on which a cantilever is mounted so as to be movable at least in two directions, with the cantilever projecting more or less outside the drilling rig. On the cantilever a Multi Purpose Tower is present, which Multi Purpose Tower is moveable relative to the platform in a second direction, different from the first direction. This Multi Purpose Tower is fixedly mounted on the cantilever and preferably forms an integral part of the construction of the cantilever.

BACKGROUND OF THE INVENTION

Drilling rigs in deep water have long needed lifting towers capable of lifting heavy items that are moveable on a deck. The ability to move this lifting tower significantly reduces safety hazards on a rig and the enables smoother operation and greater flexibility for various operations.

Blankestijn U.S. Pat. No. 6,171,027, published Jan. 9, 2001, discloses a drilling rig, in particular for the offshore industry, in the form of a Jack-Up platform on which a cantilever is mounted so as to be movable at least substantially horizontally and in a first direction, with the cantilever projecting more or less outside the Jack-Up platform. On the cantilever a drilling derrick is present, which drilling derrick is movable relative to the Jack-Up platform in a second direction, different here from. This drilling derrick is fixedly mounted on the cantilever while the latter is movable relative to the Jack-Up platform in both above directions. However, this invention does not disclose having a tower, such as a single or double hoist tower mounted on the cantilever.

In the drilling rig according to the prior art the cantilever and connected drilling derrick are movable on rails using rollers or sliding plates. These rails are fixed onto the deck or are formed of a three-part housing that workers can trip over as they move along the deck. Accidents of all sorts have occurred with the presence of the rails or three part housings on the deck of the jack up rig and other various other sorts of drilling rigs. Furthermore these rails or housings considerably limit the number of possible uses of the deck areas on which the rails or housings are fixed.

On drilling rigs according to prior art a drilling derrick is fixable mounted on the cantilever. One of the properties of a drilling derrick is the large base needed for stability. This large base determines the minimum width of the cantilever. Another disadvantage of a drilling derrick is the relative inaccessibility of the drill floor due to the large number of structural beams that are in the way. This severely limits the possible number of useful activities that can be carried out on the drill floor and consequently the number of useful activities that a drilling rig can perform.

On the majority of the drilling rigs of prior art the drilling derrick moves in transversal direction on the cantilever, the latter that can only move in longitudinal direction. The cantilever beams of existing platforms limit the transverse movement of the drilling derrick on the cantilever. As a consequence, the drilling pattern is limited to drillings within a small rectangular shape. To obtain a drilling pattern, which is nevertheless acceptable the cantilever should be of a relatively wide design.

Also when a movable drilling derrick has moved over the maximal distance in the transversal direction on the cantilever the cantilever beam on the side to which this movement took place is subjected to a considerably heavier load than the other cantilever beam. Because of such asymmetric loads on the cantilever beams occurring in practice these beams should be of a relatively heavy construction. A further drawback of the conventional rigs is that between drilling rig and cantilever, as well as between cantilever and drilling derrick, flexible connections should be provided for pipes, cable work, etc.

A need has existed for a cantilever with tower that has:

a. A moving system which is simple and more versatile compared to the rails or three part housings
b. One unit sliding bearings;
c. A lower weight
d. A smaller width
e. Increased accessibility and safety of the drill floor

SUMMARY

The invention relates to a drilling rig for offshore use having a cantilever mounted that can be rotated at least between 0 and 90 degrees or is at least moveable in two directions or both, wherein a multi purpose tower is fixably mounted on the cantilever.

The invention relates to several methods for installing, maintaining and decommissioning drilling equipment on a sub-sea well and to a method for drilling a sub sea well using a moveable cantilever with Multi Purpose Tower in combination. One method relates to placing a drilling rig with drilling equipment and a cantilever with Multi Purpose Tower near a sub-sea well, orienting the cantilever above the wellhead, picking up drill equipment from the platform using the Multi Purpose Tower, placing the drilling equipment on the well, connecting the equipment to the sub-sea well, and drilling the well.

For decommissioning a sub-sea well, the method specifically includes placing a drilling rig with drilling equipment and a cantilever with Multi Purpose Tower near a sub-sea well, orienting the cantilever above the wellhead, disconnecting the drilling equipment from the sub-sea well, picking up the drilling equipment using a Multi Purpose Tower and placing drilling equipment on the drilling rig.

BRIEF DESCRIPTION OF THE DRAWINGS

The present invention will be explained in greater detail with reference to the appended figures, in which.

Figure 1:
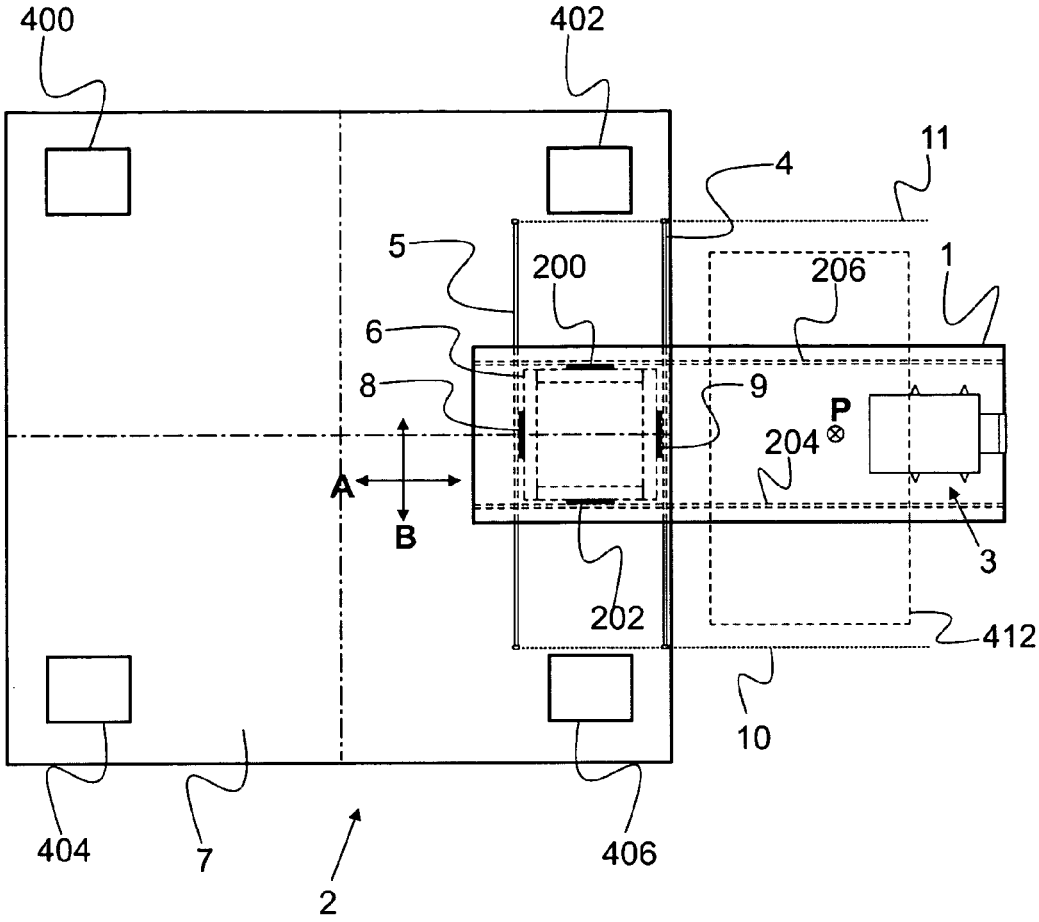
FIG. 1 shows a top view of a jack-up with a cantilever.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments and that it can be practiced or carried out in various ways.

The invention relates to methods for drilling of, performing work-overs on, and providing maintenance for sub sea wells using a moveable and/or rotating-cantilevered Multi Purpose Tower.

Also the object of the invention is to provide a drilling rig wherein the earlier mentioned drawbacks are avoided at least to a considerable extent. To this end, according to the invention, the drilling rig as described in the opening paragraph is characterized in that the drilling tower is fixedly mounted on the cantilever and the cantilever is movable relative to the drilling rig.

As a result, the drilling point always remains in the same place relative to the cantilever, viz. preferably centrally between the two cantilever side walls. This leads to a symmetric load on the cantilever and offers the possibility of giving the cantilever a lighter construction. Now, the width of the cantilever can be selected independently of the displacement in the transverse direction. By increasing the movement possibility of the cantilever in the transverse direction a larger drilling pattern can be obtained than is possible with the conventional drilling rigs. The construction according to the invention further has the advantage that flexible connections for pipes, cable work, etc. must only be provided between the drilling rig and cantilever.

The cantilever is preferably constructed for movement in its longitudinal direction with the cantilever projecting more or less outside the drilling rig, and in a direction relative to the drilling rig, which is transverse hereto. To enable these movements in an efficient manner, a supporting cart is present, which supporting cart is movable with the cantilever in the transverse direction over the deck of the drilling rig, while the cantilever is supported by the supporting cart for movement in the longitudinal direction. When movement space for the cantilever is very limited the cantilever with the Multi Purpose Tower can be movable in two directions by extending the cantilever in its longitudinal direction and rotating the supporting cart about a fixed point on the drilling rig.

In a concrete embodiment, the supporting cart slides by means of relevant operating cylinders over the deck of the drilling rig guided by guiding plates secured on the drilling rig and extending in the transverse direction. When the cantilever is movable in two directions by extending the cantilever in its longitudinal direction and rotating the connection cart about a fixed point on the drilling rig no guiding plates are necessary at all.

When the supporting cart slides over the deck or the cantilever slides over the supporting cart considerable shearing forces occur. In order to at least partially relieve the parts sliding over each other in this regard at least the two sliding bearing members that are movable over the deck or rails located closest to the edge of the drilling rig may comprise friction-reducing means which are operative in the longitudinal direction as well as in the transverse direction, to take up at least a part of the frictional forces between the supporting cart and the relevant deck area and between the bottom plate area of the cantilever and the supporting cart. In a concrete embodiment, these friction-reducing means are formed by hydrostatic bearings. It is contemplated that mud pumps can be used to pressurize the hydrostatic bearings avoiding the need for separate power packs.

The present invention will be described further with reference to the appended drawings.

It should be noted that in FIG. 1, FIG. 2, FIG. 10, FIG. 11, and FIG. 15 the drilling rig is shown in the specific embodiment of a Jack Up platform, but that the invention is not limited to this specific embodiment.

FIG. 1 shows Multi Purpose Tower (3) located on the cantilever (1). FIG. 1 also shows that cantilever (1) is supported on deck (7) by supporting cart (6) guided by first guiding plate (4), second guiding plate (5) and moved by first push-pull unit (8) and second push-pull unit (9). Guiding plates (4) and (5) can also act as locking plates onto which first push-pull unit (8) and second push-pull unit (9) can lock to move supporting cart (6). It is contemplated that the push-pull units can also lock onto deck (7) directly. The third push pull unit (200) and fourth push pull unit (202) in longitudinal direction move the cantilever (1). Guiding plates (204) and (206) can also act as locking plates onto which third push-pull unit (200) and fourth push-pull unit (202) can lock to move cantilever (1) in longitudinal direction.

Hence, with the interposition of the two movements, cantilever (1) is movable back and forth along the edge of Jack-Up platform (2) through a distance determined by first end position (11) and second end position (10) that can be reached by supporting cart (6), and further over supporting cart (6) into a position in which Multi Purpose Tower (3) more or less projects outside Jack-Up platform (2).

In this embodiment, Multi Purpose Tower (3) is fixedly attached to cantilever (1) and hence moves along therewith in the directions indicated by the arrows A and B. It is contemplated that Multi Purpose Tower (3) could be removable attached to the cantilever and still be usable in the scope of the invention. However it should be noted that in a preferred embodiment Multi Purpose Tower (3) and cantilever (1) form one L-shaped load bearing structure. By integrating the two structures significant weight can be saved. Creating a drilling rig, which is safer, more flexible, and more adaptable to the environment than known conventional rigs with drilling derricks. The construction of the tower is also unique and unlike conventional derricks or tubular tower-like constructions. Multi Purpose Tower (3) has a number of features, including that it can be of a hollow construction. In one embodiment, it is envisaged that the tower is constructed from containers for hauling material, such as containers from a container ship.

Figure 2:
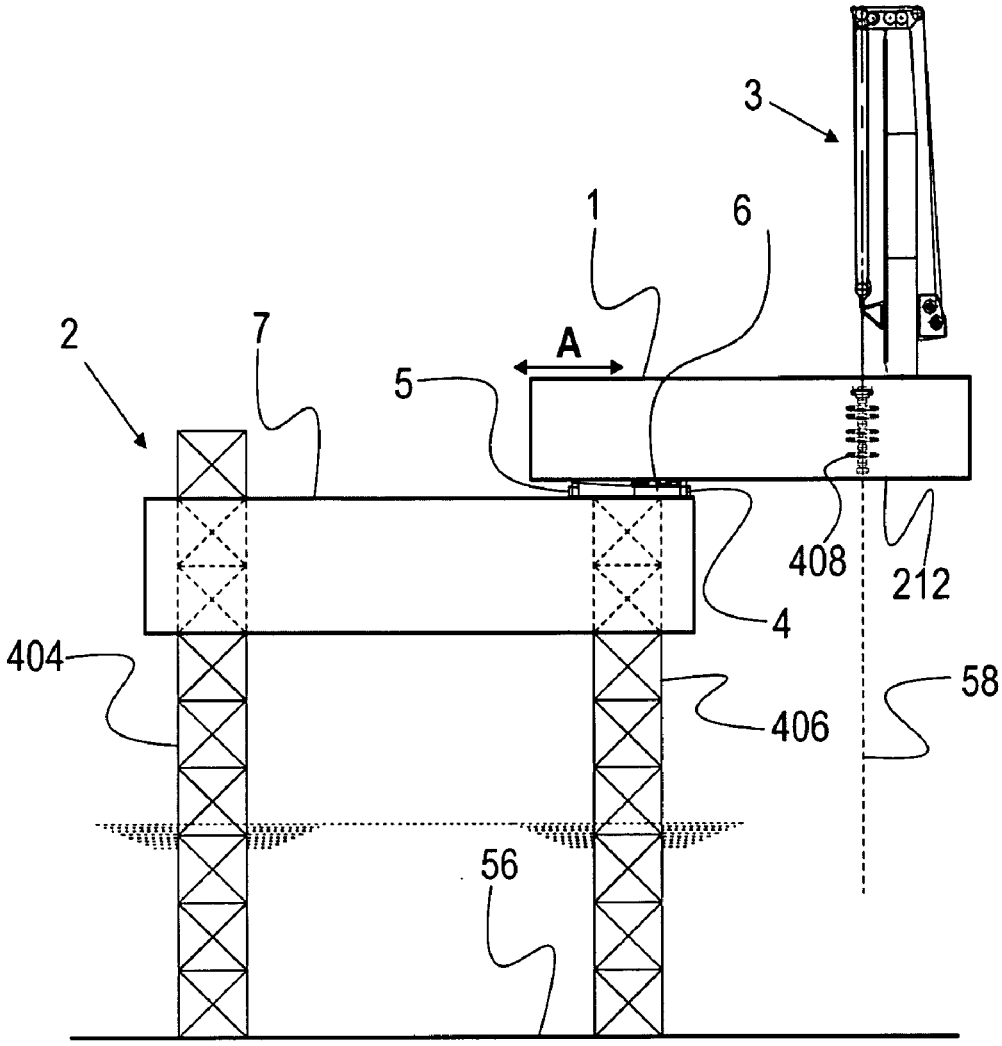
FIG. 2 shows a side view of a jack-up with a cantilever.

FIG. 2 shows a side view of a jack up rig with Multi Purpose Tower (3) from the view where the third post (404) and fourth post (406) resting on the sea bottom (56) can be viewed. A blowout prevention valve (408) is secured to cantilever (1) and it should be noted that further equipment, tools and materials required for drilling could be secured to cantilever (1). Also visible is firing line (58).

Cantilever bottom plate (212), which rests on the bearings (19), (20), (21) and (22) mounted on supporting cart (6), which rests on bearings (40), (41), (42) and (43) on deck (7) of the jack up rig (2).

The point from which the drilling takes place is indicated by P in FIG. 1; by moving cantilever 1 in the directions A and B, this drilling point P can be moved to all desired locations within the rectangle (412) and the desired number of drillings at the desired mutual distances can take place Typically a rectangle is proscribed by the cantilever, which moves only in two directions. However, other shapes can also be accomplished, particularly if the cantilever is rotatable, or moveable in more than just the two directions. For example an ellipsoidal pattern could be proscribed. In addition, the size of the drilling pattern can be enlarged by increasing the size of the rectangle such as by increasing the distance through which the cantilever can be shifted in the directions A and B. In an embodiment, it is contemplated that the drilling pattern can be 30 feet by 100 feet.

Figure 4:
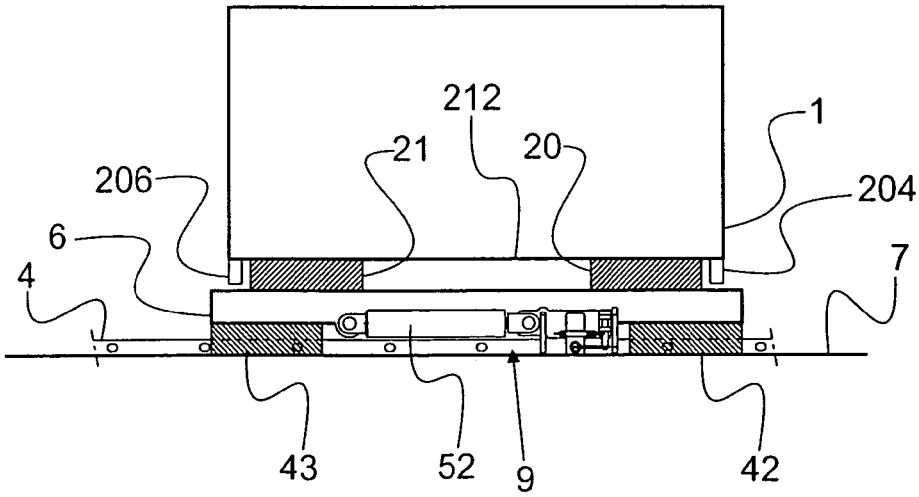
FIG. 4 shows a side view of a cantilever facing to the drilling platform.

FIG. 4 shows a side view of a cantilever facing to the drilling platform.

Figure 3:
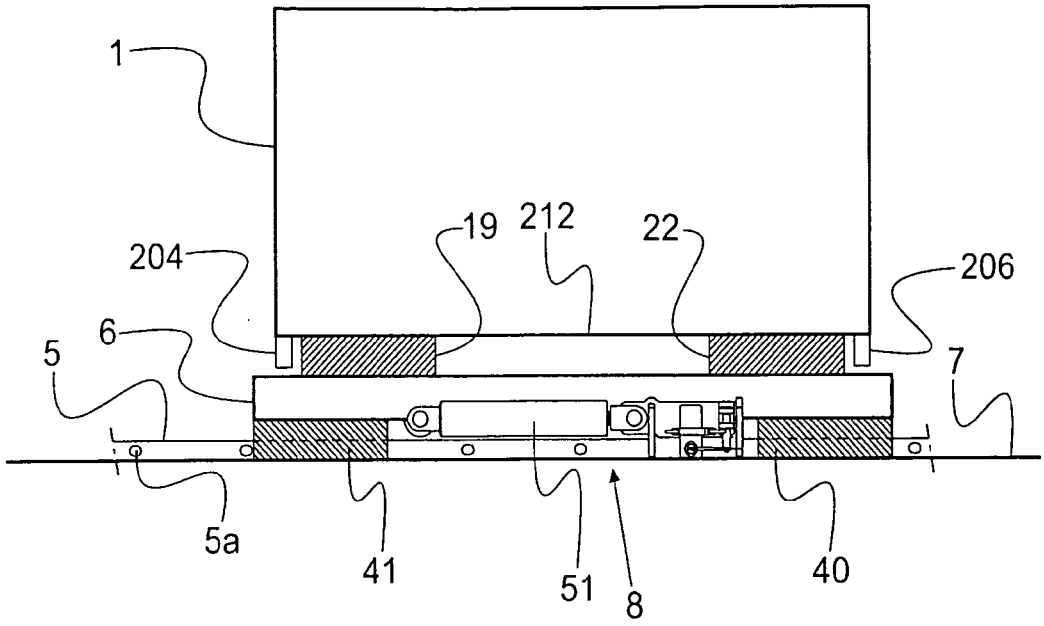
FIG. 3 shows a side view of a cantilever facing away from the drilling platform.
Figure 5:
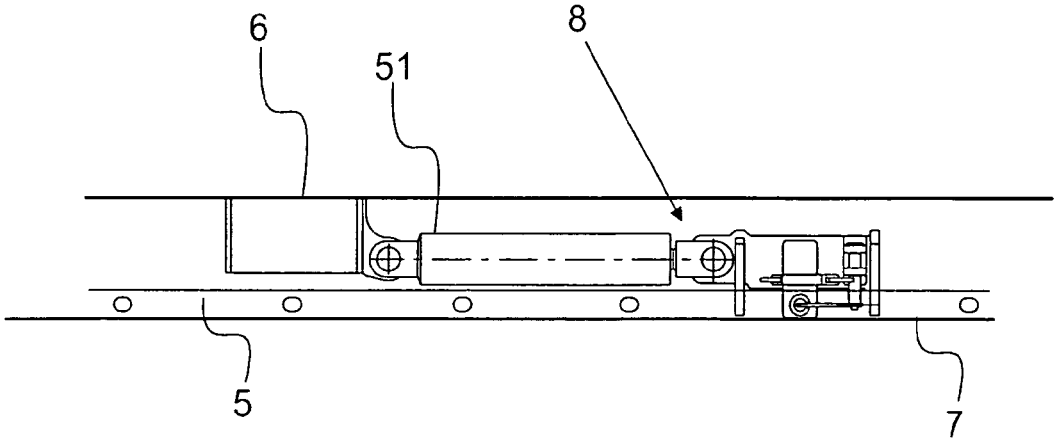
FIG. 5 shows a detailed view of a push-pull unit.

The two push pull units (8), (9) whereby the supporting cart (6) can be shifted over the deck (7) are indicated in the rear view given in FIG. 3 and the top view given in FIG. 1, while push-pull unit (8) is also depicted in an enlarged view in FIG. 5.

The manner in which supporting cart (6) slides over deck (7) and the manner in which cantilever (1) slides over supporting cart (6) is always the same, to the effect that the slide means for the deck (7) are of the same design and construction as the slide means for the cantilever (6). In a preferred embodiment there is only one sliding means for both movements.

Since the weight of the cantilever (1) with accessories is massive, reactive forces will occur in the supporting members. For this reason, the supporting cart is provided with friction-reducing devices that are operative both in the longitudinal and transverse directions. These friction-reducing devices can be bearings, preferably hydrostatic bearings. These reactive forces will be considerably greater in the sliding bearings (42), (43), (20), and (21) than in the sliding bearings (19), (22), (41), and (40).

Figure 6:
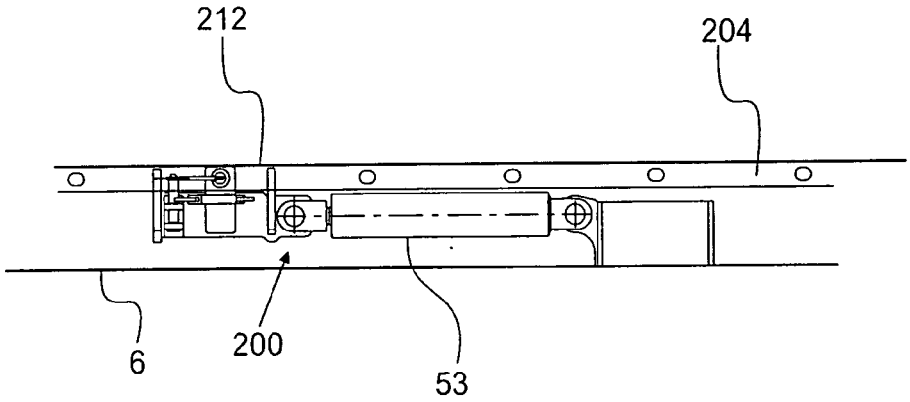
FIG. 6 shows a detailed view of a push-pull unit.

FIG. 6 shows third push-pull unit (200). FIG. 6 is similar to FIG. 5 in representing one of the push-pull units also referred to as the hydraulic cylinders used to move the cantilever (1). The third push-pull unit's (200) main component is the third hydraulic cylinder (53). All of the hydraulic cylinders of each push-pull unit are preferably arranged between the relevant supporting members and slide plates. It must be noted that the construction of push-pull units is well known from prior art.

Figure 7:
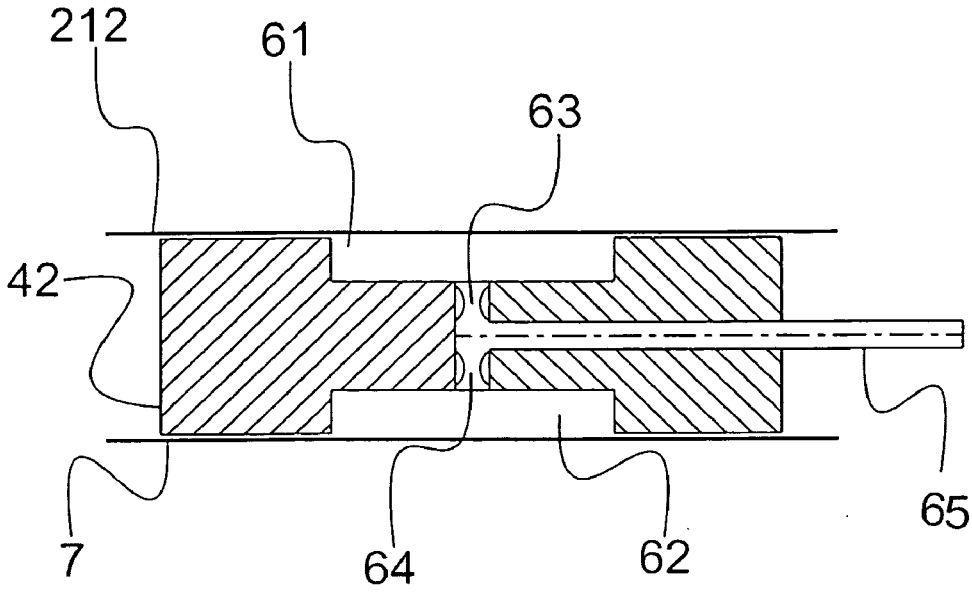
FIG. 7 shows a cross sectional view of a double side hydrostatic sliding bearing.

FIG. 7 shows bearing (42) in which both the longitudinal movement and the translational movement are taken by the same bearing with two load carrying sides. In order to keep the sliding bearing in the correct position resistance elements (63) and (64) are located in the fluid supply line (65).

Figure 8:
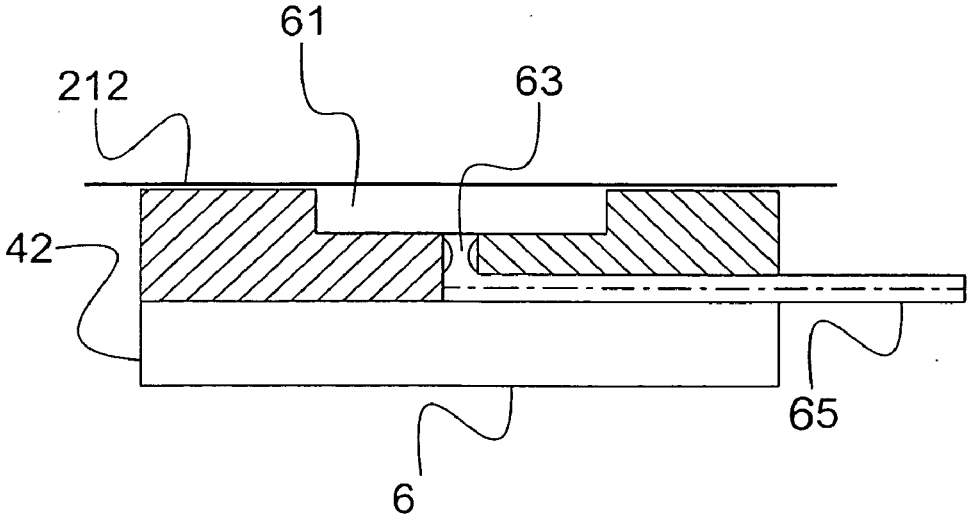
FIG. 8 shows a cross sectional view of a single side hydrostatic bearing.

FIG. 8 shows another embodiment of bearing (42) with only one load carrying side. The bearing is fixably mounted on the support cart (6).

Figure 9:
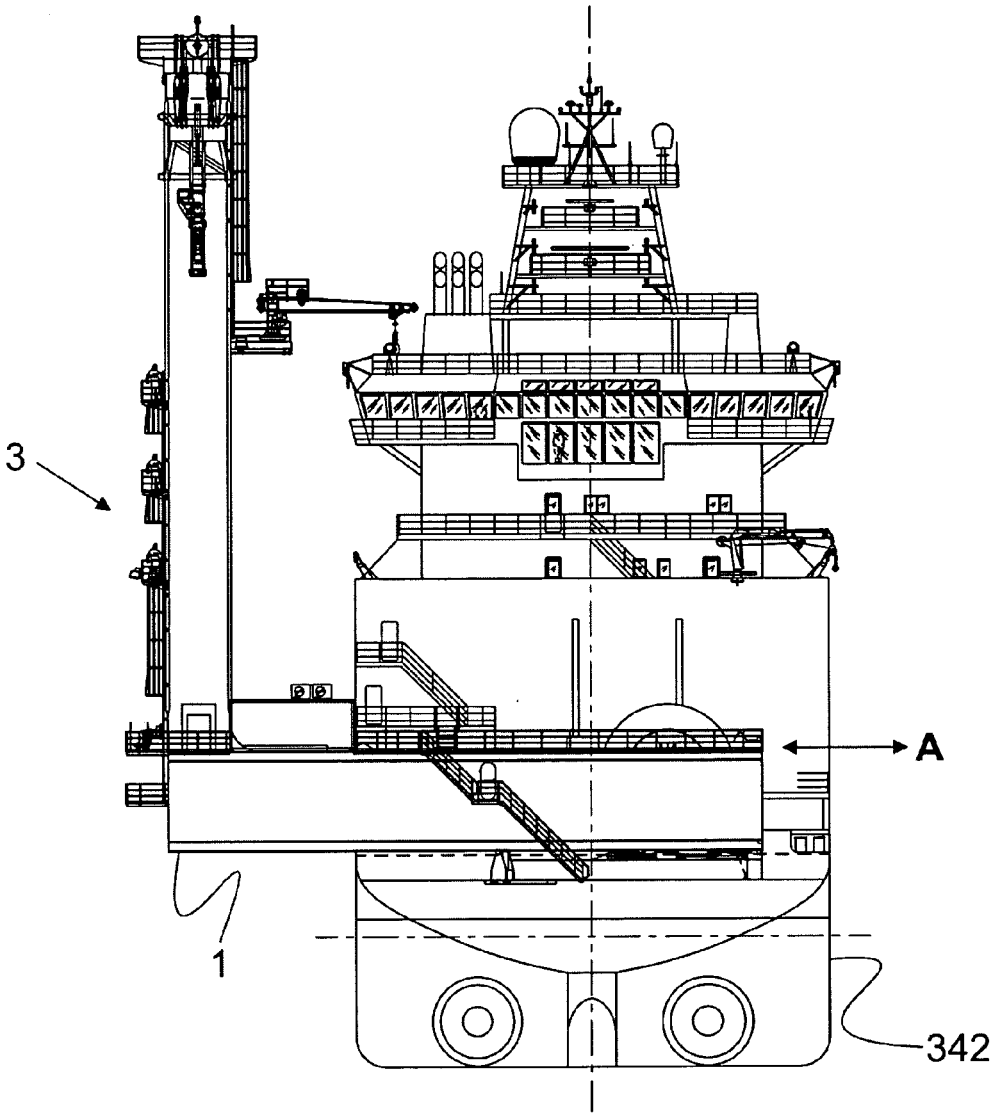
FIG. 9 shows a back view of a supply vessel with cantilever and multipurpose tower.
Figure 10:
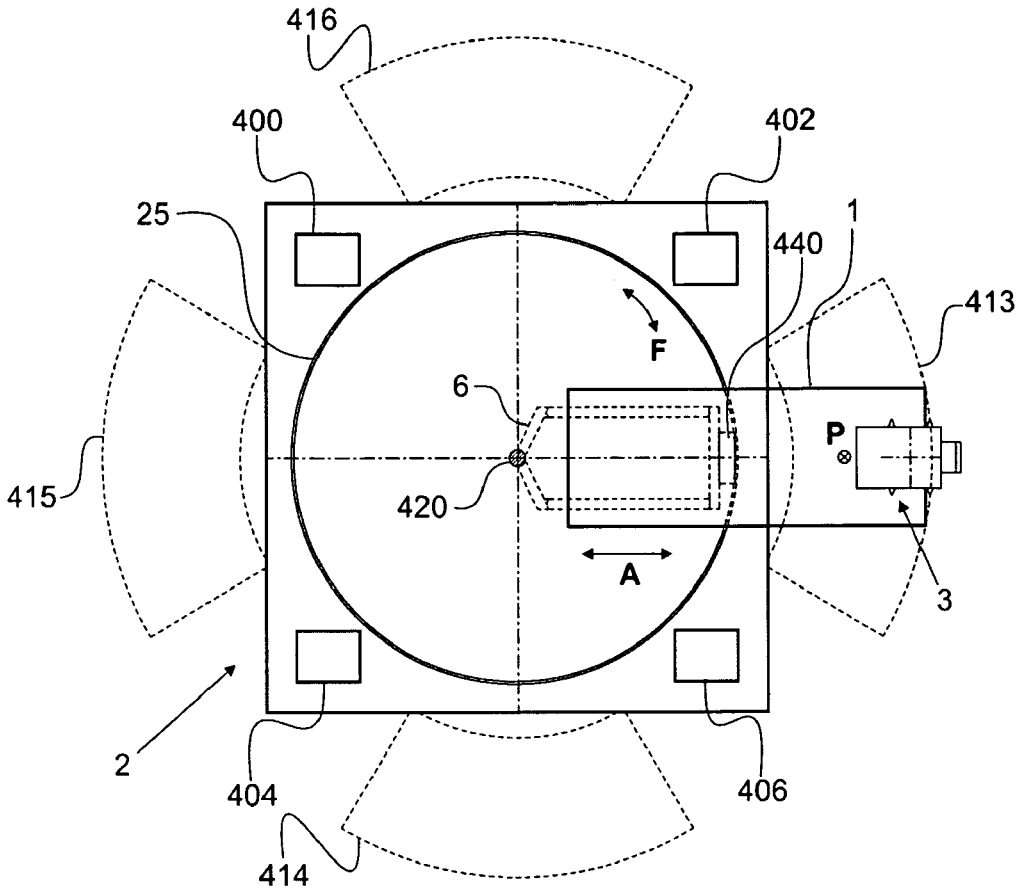
FIG. 10 shows a top view of a 360 degree rotatable cantilever on a jack-up.

FIG. 9 shows a back view of a supply vessel with cantilever and multipurpose tower;

FIG. 10 shows another embodiment of moving cantilever (1). Cantilever (1) can move in longitudinal direction over supporting cart (6), which can rotate about rotating point (420) in the direction indicated by F over 360 degrees; by moving cantilever (1) in the directions A and F, drilling point P can be moved to all desired locations within first drilling area (413), second drilling area (414), third drilling area (415) and fifth drilling area (416). Supporting cart (6) is moved along direction F by push pull-unit (440) that locks on locking plate (25). The locking plate is removable connected to deck (7) and can be completely of one circular piece or consist out of several different sections.

Figure 11:
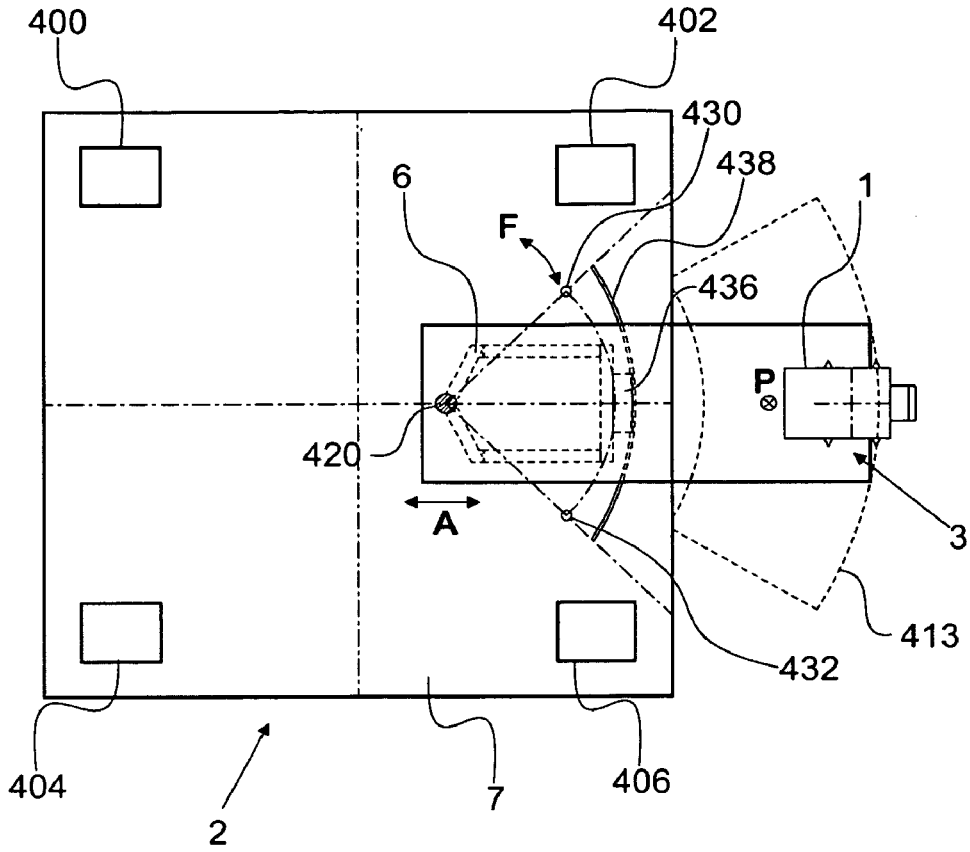
FIG. 11 shows a rotatable cantilever on a jack-up.

FIG. 11 is a top plan view showing another embodiment of moving cantilever (1) which, relative to a jack-up platform (2), is movable in its longitudinal direction as indicated by the arrow A, and can be rotated indicated in the direction indicated by the arrow F. Supporting cart (6) can, in this embodiment, be rotated around rotating pin (420). Hence, with the interposition of the longitudinal movement and the rotational movement, cantilever (1) is movable along the edge of jack-up platform (2) through a distance determined by first end position (430) and second end position (432) that can be reached by supporting cart (6) over deck (7) of jack-up (2), and further over supporting cart (6) into a position in which Multi Purpose Tower (3) more or less projects outside Jack-Up platform (2). Supporting cart (6) is moved along direction F by push pull-unit (436) that locks on locking plate (438). The locking plate is removable connected to deck (7). By moving cantilever (1) in the directions A and F, drilling point P can be moved to all desired locations within first drilling area (413).

Figure 12:
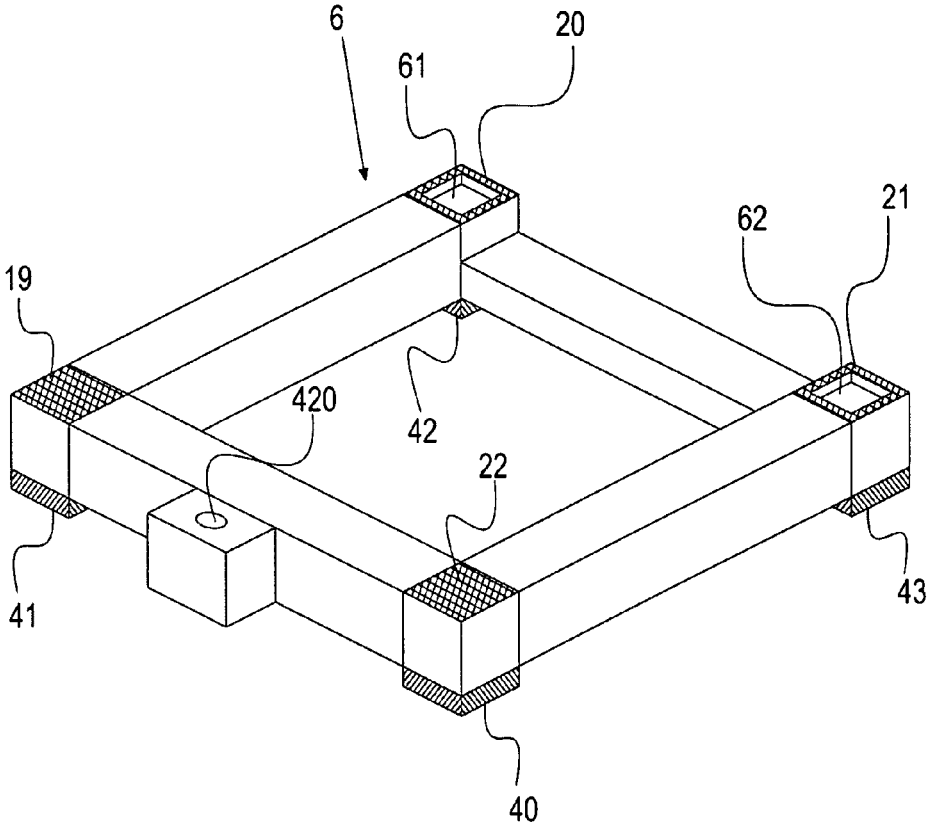
FIG. 12 shows a perspective view of a rotatable supporting cart.

In FIG. 12, a rotating supporting cart is shown. The rotating cart has the same number of bearings compared to a translating supporting cart.

Figure 13:
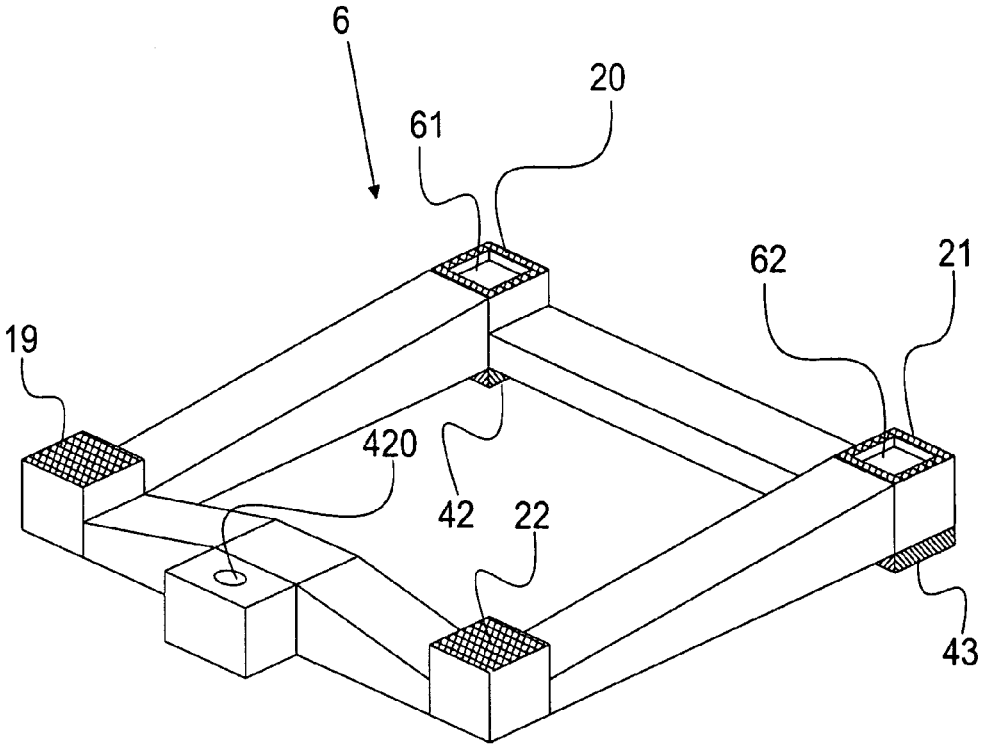
FIG. 13 shows a perspective view of a rotatable supporting cart with a decreased number of bearings.

FIG. 13 shows a rotating supporting cart on which the number of bearings is minimized. It can be seen that bearings (40) and (41) are no longer present. The advantage is that there are fewer bearings.

Figure 14:
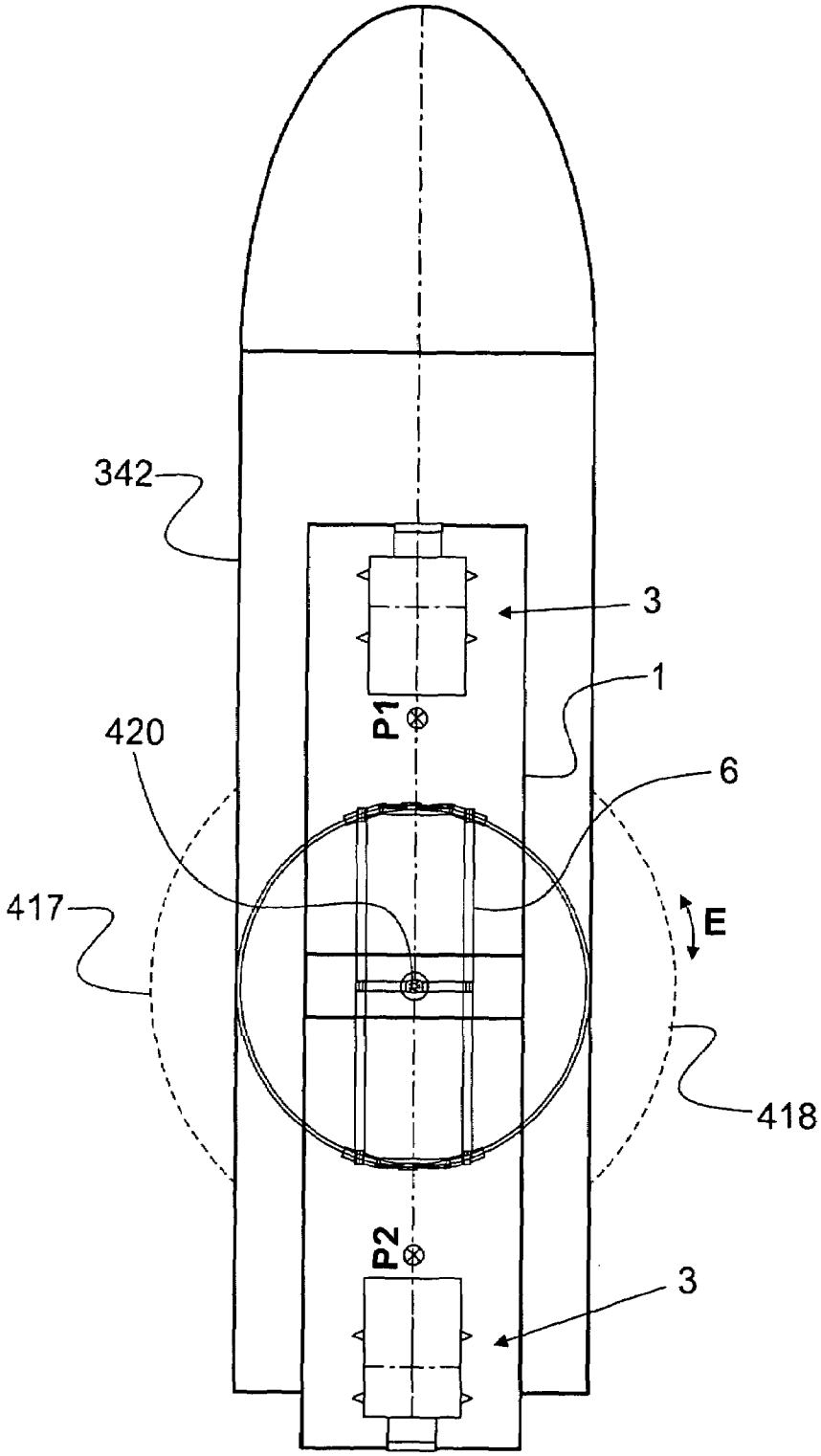
FIG. 14 shows a rotatable cantilever on a drilling ship.

FIG. 14 shows a top view of an embodiment of a moving cantilever (1) on a Mono Hull Ship (342). Cantilever (1) can move in longitudinal direction over supporting cart (6). Supporting cart (6) can rotate about rotating pin (420) in the direction indicated by E up to 360 degrees; by moving cantilever (1) in the direction E and A, drilling point P can be moved to all desired locations within fifth drilling area (417) and sixth drilling area (418). In this specific embodiment cantilever (6) is fitted with two Multi Purpose Towers (3).

Figure 15:
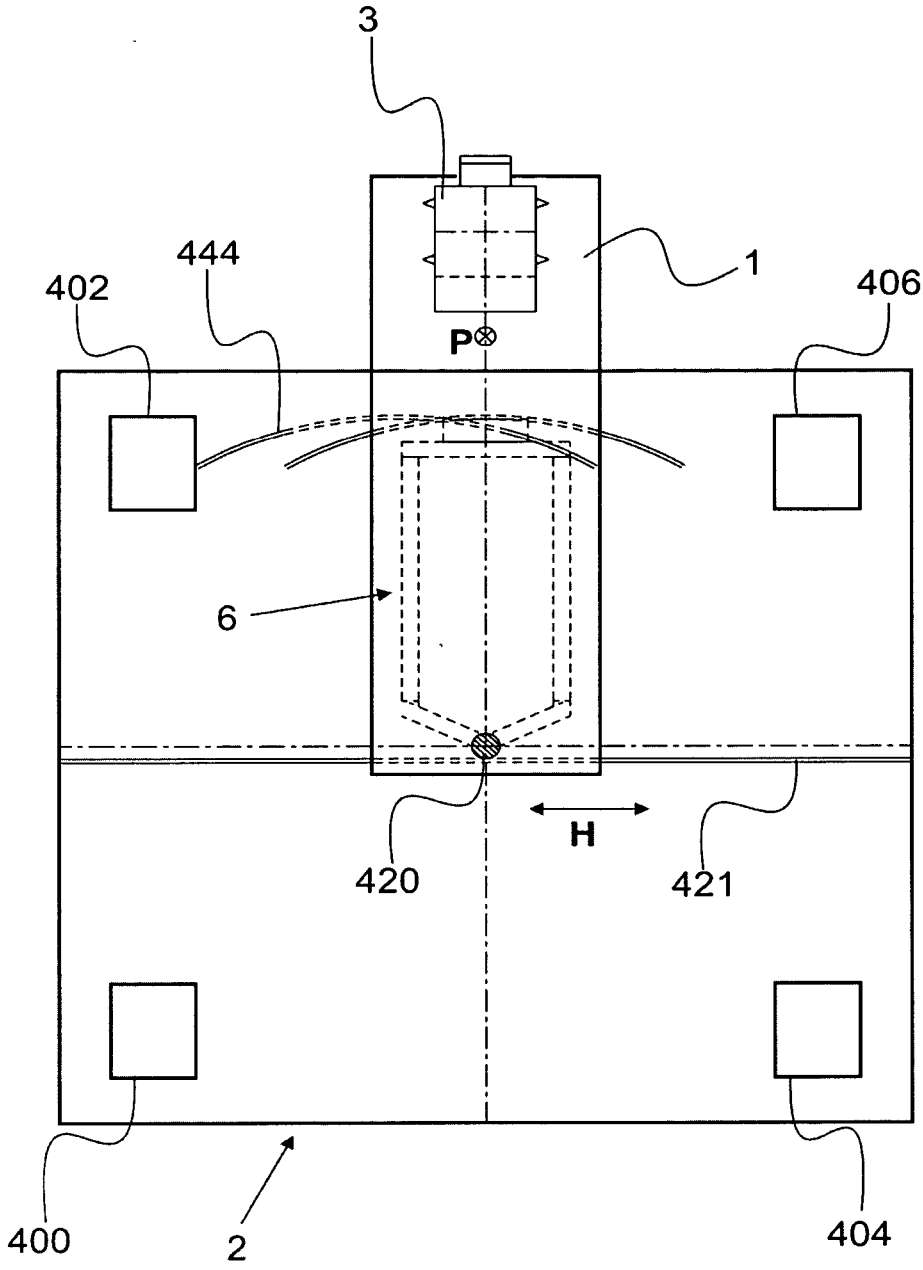
FIG. 15 shows a top view of a rotatable cantilever which can also translate.

FIG. 15 shows a top view of another embodiment of a moving cantilever with a movable rotating pin (420) mounted on jack-up drilling rig (2). The rotating pin (420) can move in direction H. The locking plate (444) is removable attached to deck (7) to be able to move with the rotating pin (420). In some cases a rotational, translational and longitudinal movement can be an advantage. For example to minimize wind loading on the structure or to facilitate easy tubular transport.

Cantilever (1) can be shifted in the longitudinal direction over the supporting cart by the hydraulic cylinders (53) and (54) of which only cylinder (53) is shown in the push-pull units (200) and (202) activated in synchronization. The supporting cart (6) is shifted in the transverse direction by hydraulic cylinders (51), (52) of the push pull units (8) and (9) activated in synchronization. After that, the slide members can again be secured on the relevant guiding plates and the supporting members can again be displaced. In this manner, the supporting cart (6) and, accordingly, cantilever (1) can be displaced stepwise in transverse or longitudinal direction. By securing all push pull units cantilever (1) is fully secured on drilling rig (2). Apart from the push-pull units separate locking devices can be used.

For this reason, the sliding bearings (42), (43), (20) and (21) are provided with first chamber (61), second chamber (62), third chamber (67) and fourth chamber (68), of which bearings (67) and (68) are not visible, in which fluid under high pressure can be pumped. The fluid will lower the friction of the bearing considerably. The construction of hydrostatic bearings is well known from previous art.

Figure 16:
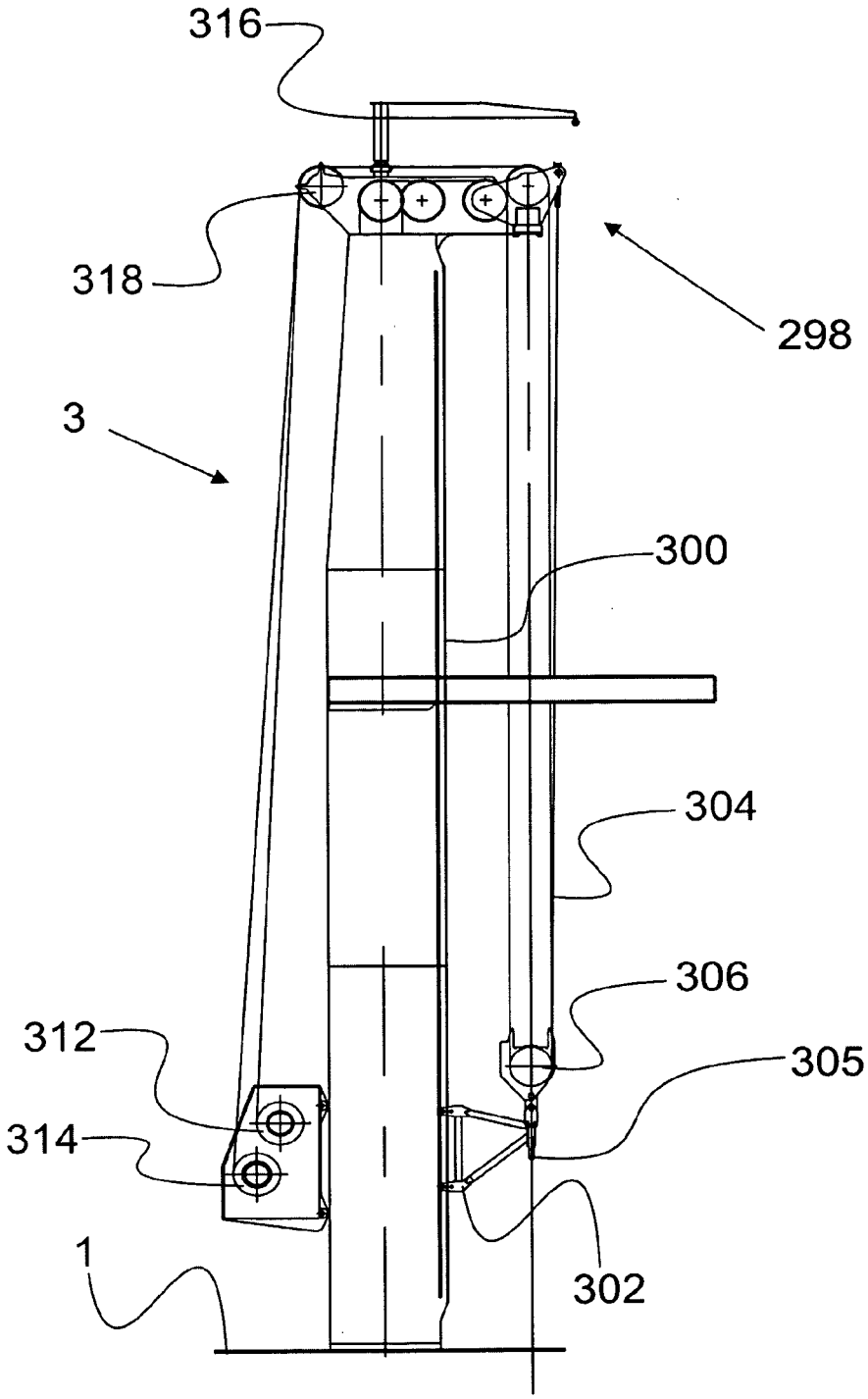
FIG. 16 shows a side view of a multi purpose tower.

FIG. 16 shows a side view of Multi Purpose Tower (3) comprising mast (300) provided with cable blocks (298), a trolley (302) moveable fixed to the mast (300), and having a bottom side provided with a gripper (305), a hoist, at least one hoisting cable (304), a plurality of winches (312), (314), wherein the hoisting cable is guided over cable blocks (318) and (306) of the mast and trolley, and wherein the trolley is movable relative to the mast using the hoisting cable. Winches are secured to the hoists. In one embodiment, one winch per hoist can be used. In a preferred embodiment, two winches (312), (314) per hoist are contemplated. The dual or redundant system this provides adds additional capacity and alternatively additional reliability to the system. Each winch can have one or more brakes, for use in hoisting. A preferred brake is a slip brake. Located on top of the multi purpose tower is service crane (316) that can be used for all kinds of small hoisting jobs.

Multi Purpose Tower (3) can have a single hoist, which is also referred to herein as a single hoisting device, a dual hoist system, or a multiple hoist system, having 3, 4 and up to at least 8 hoists disposed on the tower and usable simultaneously or in sequence. These multiple hoist systems are a significant time saver and safety benefit on a rig. The multiple hoists permit loads to stay attached, preventing head injuries and back injuries that can occur with loading and unloading a single hoist system.

Figure 17:
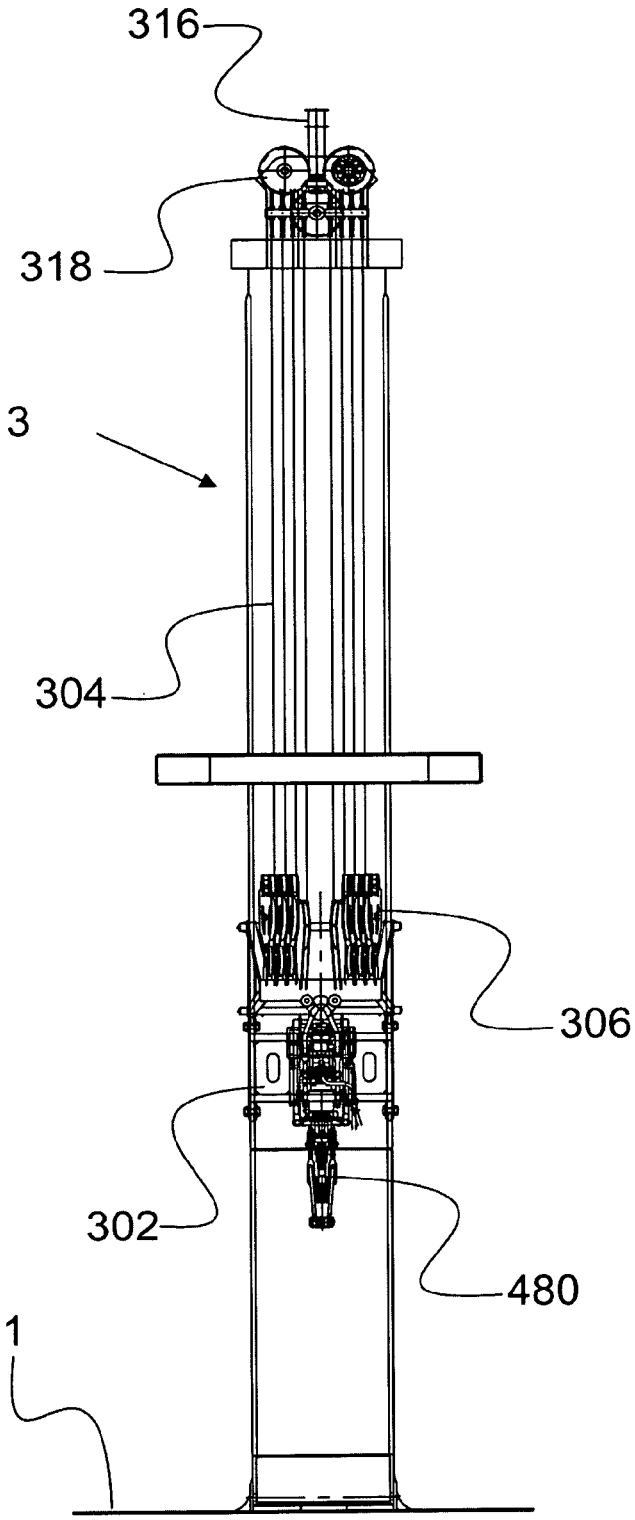
FIG. 17 shows a front view of a multi purpose tower.

FIG. 17 shows a front view of Multipurpose Tower (3).

Figure 18:
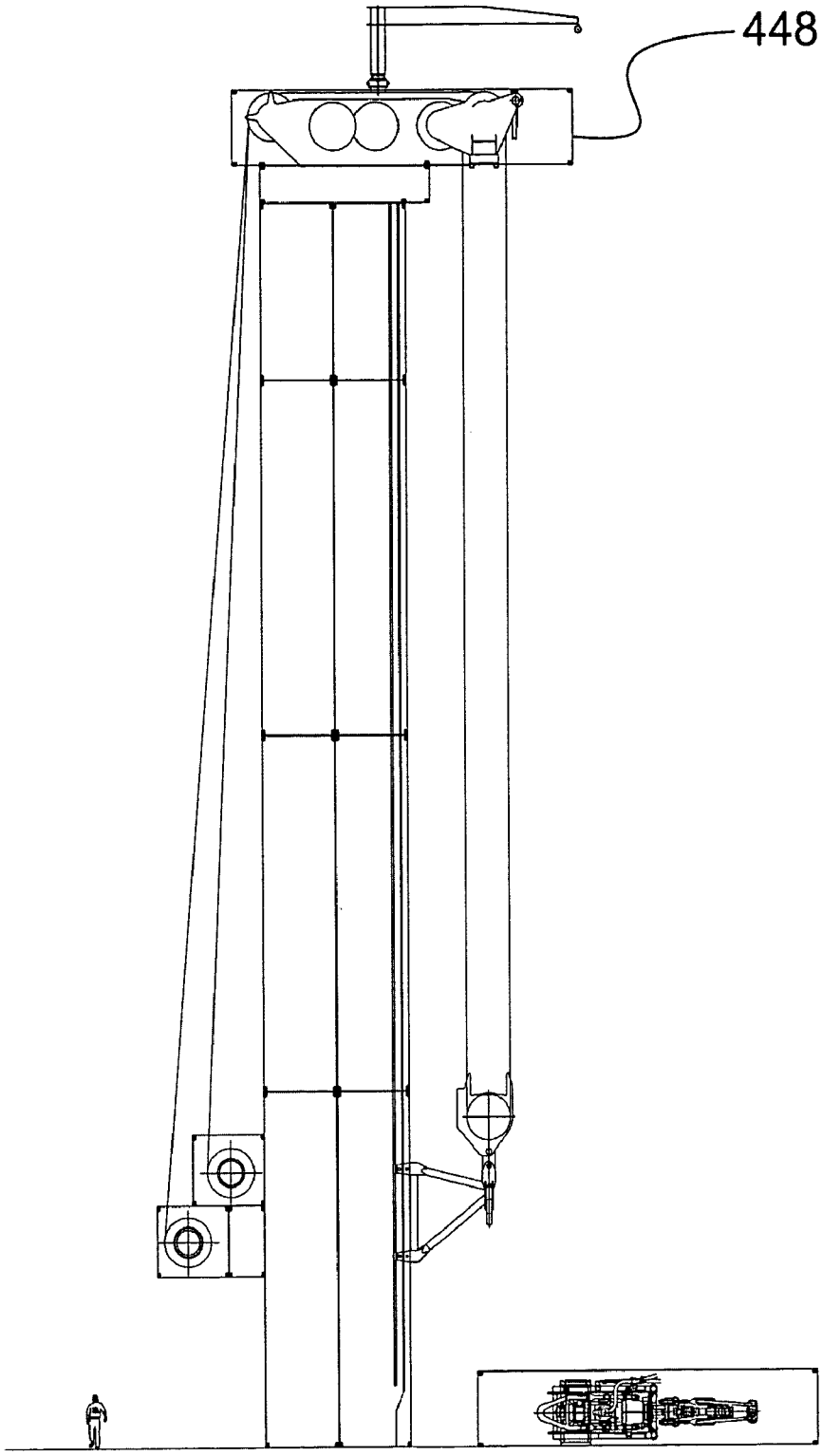
FIG. 18 shows a containerized version of a multipurpose tower.

It is advantageous according to the invention for the mast to be designed in the form of a tube or sleeve. The mast can be a modular mast made from containers (448) connected together as shown in FIG. 18. The mast can be rectangular, octagon or any number of geometric shapes. The mast is preferably hollow with a housing of steel but other materials could be used which have the strength of steel. The mast could be solid In order to keep the position of the trolley (302) substantially constant relative to the seabed during the drilling, Multi Purpose Tower (3) can be provided with a heave compensation system. The heave compensation system can compensate for the movements that the drilling rig makes relative to the seabed, as a result of wind, swell and the like. Of course when the Cantilever Multi Purpose Tower is mounted on a Jack-Up drilling rig the heave compensation system is not necessary.

The winches used for paying out or hauling in the hoisting cables required for the trolley (302) can be accommodated on the outside or inside of the tower. That means that the winches and other facilities do not have to be placed on board the ship, which gives a considerable space saving. The means that are necessary for the heave compensation, such as, for example, cylinders, are also fitted in Multi Purpose Tower (3) itself.

A further advantage of the mast according to the invention is that the mast can be assembled and tested in its entirety. The mast can then be taken ready for use to the place where it is to be used, and placed on a vessel.

Figure 19:
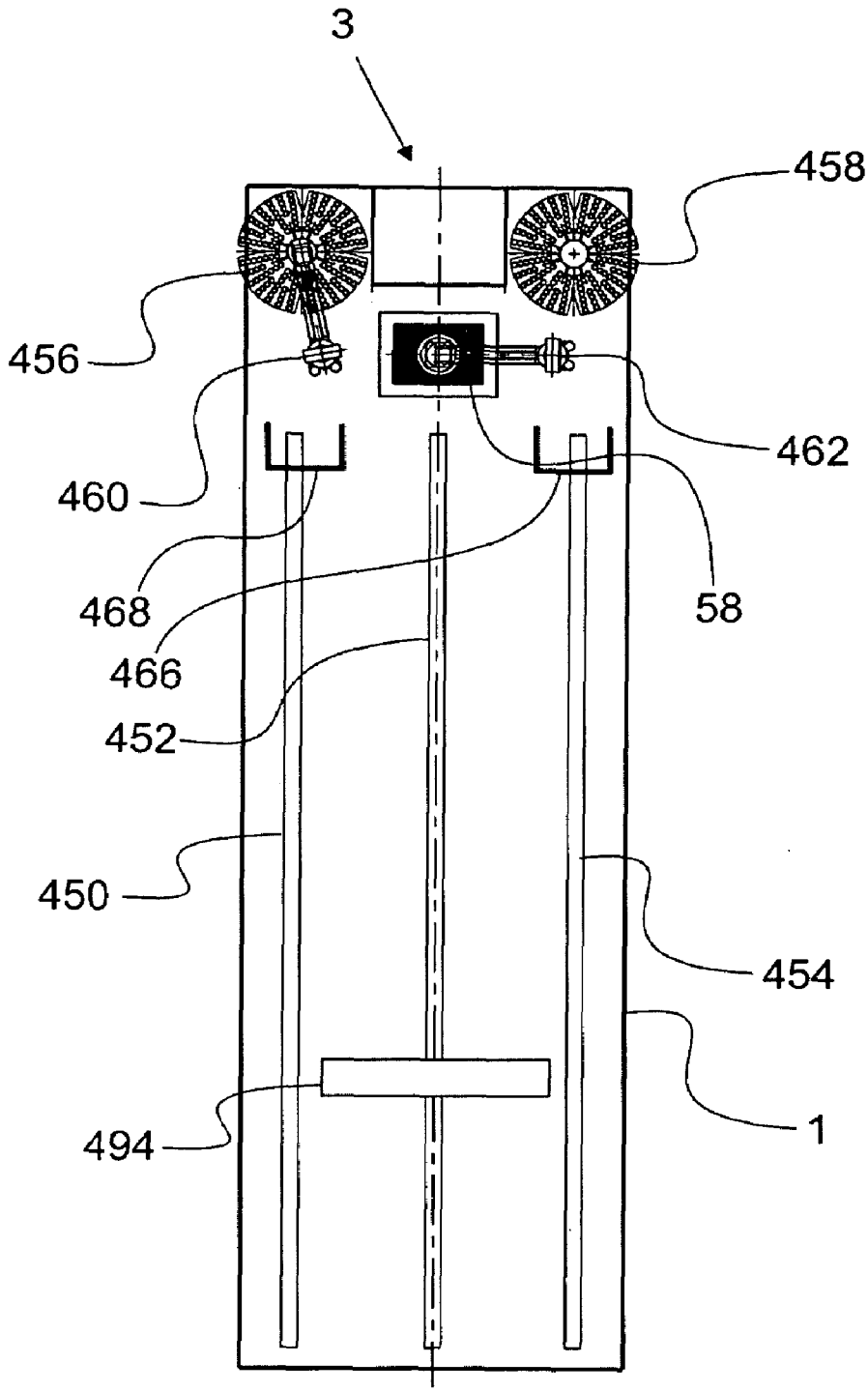
FIG. 19 shows a top view of a cantilever with multipurpose Tower.

FIG. 19 shows a top view of cantilever (1) with multipurpose tower (3) fixably mounted on one end. Standard tubulars can be fed to Multipurpose Tower (3) through first feeding path (450), second feeding path (452) and third feeding path (454). Next to the tower first setback drum (456) and second setback drum (458) are fixably mounted to Multipurpose Tower (3) and cantilever (1). The setback drums have the capability to rotate around a vertical axis. To place tubulars in the setback drums (456) and (458), transport tubulars to firing line (58) and to place tubulars in or out first container (466) and second container (468), first pipe racker (460) and second pipe racker (462) are fixably mounted to the multi purpose tower (3) and on cantilever (1). The construction of the setback drums and the pipe rackers is well known from prior art. A gantry crane (494) is able to move longitudinally over the cantilever to place equipment such as blow out preventers in the firing line (58).

Figure 20:
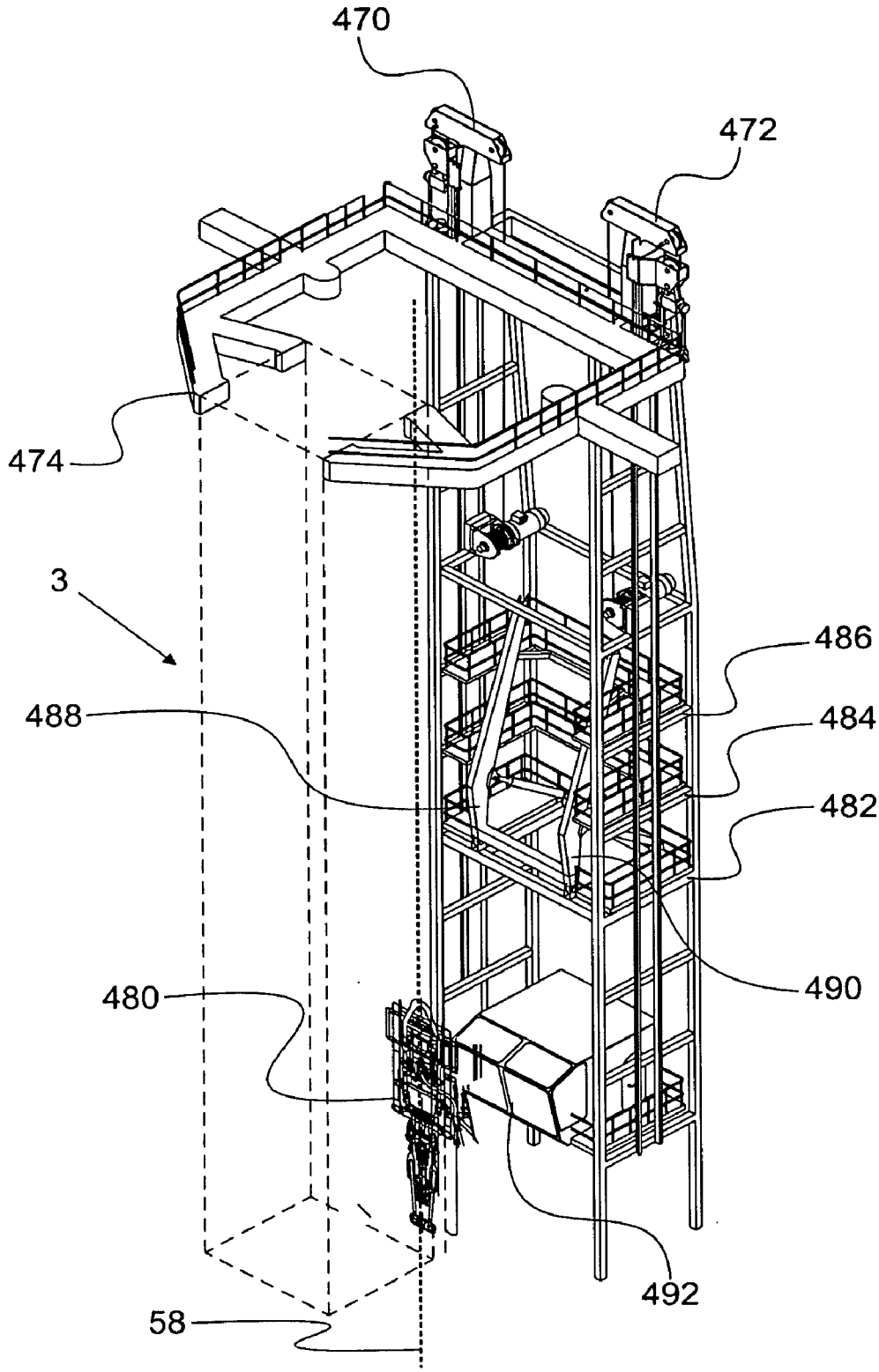
FIG. 20 shows a perspective view of a supporting structure.

FIG. 20 shows a perspective view of supporting structure (474) fixable connected to multipurpose tower (3) and cantilever (1). Incorporated in supporting structure (474) are first stand builder (470) and second stand builder (472). Drillers cabin (492) is movably mounted inside supporting structure (474). The service topdrive (480), first working platform (482), second working platform (484) and third working platform (486) are fixably mounted inside the supporting structure. To hold the topdrive (480) first catching arm (488) and second catching arm (490) are movably mounted inside the supporting structure. The catching arms can rotate into firing line (58) to catch topdrive (480) and transport it to working platforms (482, 484 and 486).

Figure 21:
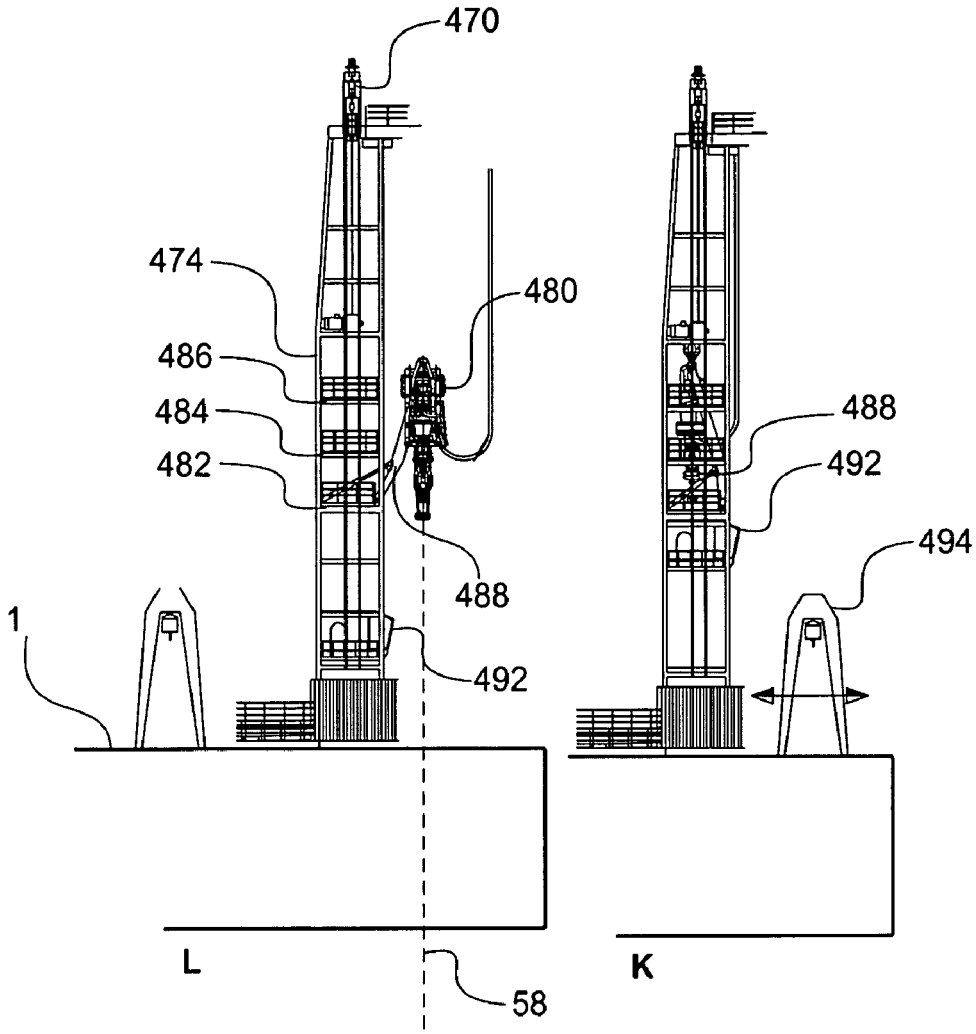
FIG. 21 shows two different positions of the topdrive and drillers cabin.

FIG. 21 shows the topdrive (480) in normal position (L) and in retracted position (K). Drillers cabin (492) is shown in a high position and a low position. In the high position there is enough room under drillers cabin (492) to let pass the gantry crane (494) that is traveling in longitudinal direction over the cantilever (1). The gantry crane can reach firing line (58) and lift heavy objects such as a complete blow out valve. This is an advantage. The advantage of retracting topdrive (480) to the working platforms is that maintenance is safer and faster due to the improved access to the topdrive. No man-riding winches are needed.

Figure 22:
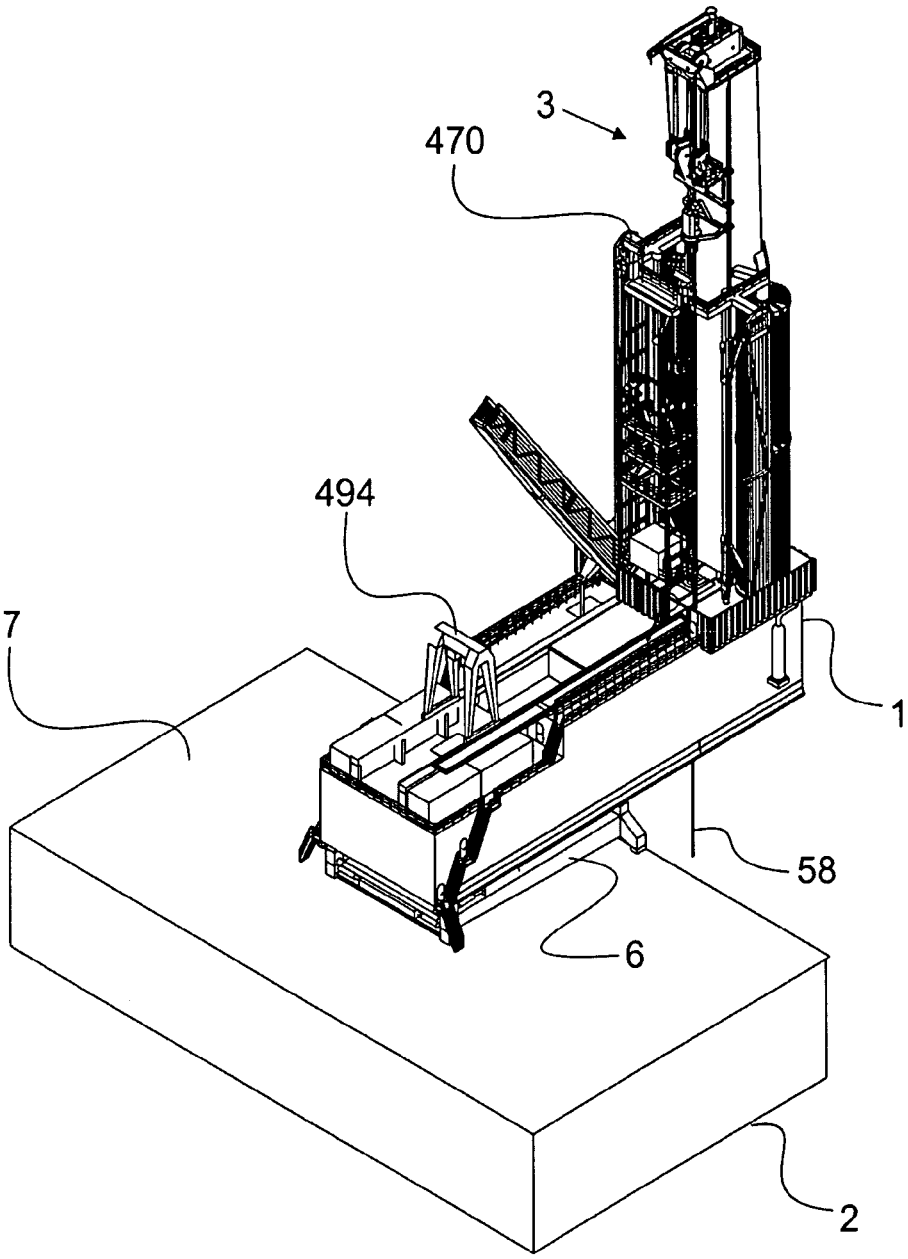
FIG. 22 shows a perspective view of a cantilever with multipurpose tower.

FIG. 22 shows a perspective view of cantilever (1) and multipurpose tower (3). Located on the cantilever are first container lifting device and second container lifting device to lift containers to a vertical position where the tubulars can be reached by the pipe rackers. Containers are fed trough first tubular feeding line and second tubular feeding line to the multipurpose tower. Having two independent tubular feeding lines to the multipurpose tower creates a large redundancy.

Figure 23:
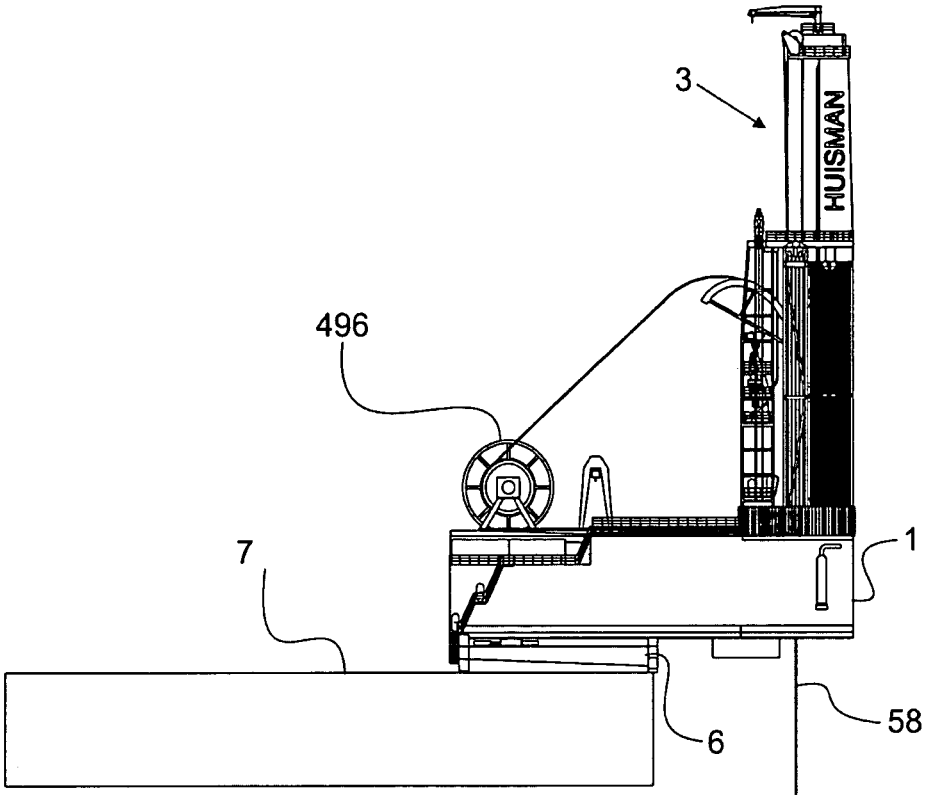
FIG. 23 shows a side view of a multi purpose tower on a cantilever with a coiled tubing unit.

FIG. 23 shows a side view of cantilever (1) on which coiled tubing unit (496) is installed on cantilever (1) together with supporting equipment. Such equipment is well known.

While this invention has been described with emphasis on the preferred embodiments, it should be understood that within the scope of the appended claims, the invention might be practiced other than as specifically described herein.

The invention is by no means limited to the exemplary embodiment described hereinabove, but comprises various modifications hereto, in so far as they fall within the scope of the following claims.

This invention contemplated a method for installing drilling equipment on a sub-sea well and drilling the well comprising a. placing a drilling rig with drilling equipment and a cantilever with Multi Purpose Tower near a sub-sea well;
b. orienting the cantilever above the wellhead; using a rotational and a translational movement or only translational movements;
c. picking up drill equipment from the drilling rig using a Multi Purpose tower wherein the tower comprises a mast, on the top side provided with cable blocks fixedly connected to it; a trolley, which is movably fixed on the mast, on the top side is provided with cable blocks, and on the bottom side is provided with a gripper; hoist, a hoisting cable attached to the hoist and a winch, the hoisting cable being guided over the cable blocks of both the mast and the trolley, and it being possible to move the trolley relative to the mast with the aid of the hoist;
d. placing drilling equipment on the sub-sea well;
e. connecting the equipment to the sub-sea well; and
f. drilling the well.

The invention also contemplates a method for decommissioning a sub-sea well comprising a. placing a drilling rig with drilling equipment and a cantilever and multi purpose tower near a sub-sea well;
b. orienting the cantilever above the wellhead; using a rotational and a translational movement or only translational movements;
c. disconnecting the drilling equipment from the sub-sea well;
d. picking up the drilling equipment using a multi purpose tower wherein the tower comprises a mast, on the top side provided with cable blocks fixedly connected to it; a trolley, which is movably fixed on the mast, on the top side is provided with cable blocks, and on the bottom side is provided with a gripper; hoist, a hoisting cable attached to the hoist and a winch, the hoisting cable being guided over the cable blocks of both the mast and the trolley, and it being possible to move the trolley relative to the mast with the aid of the hoist; and
e. placing drilling equipment on the drilling rig.

Embodiments of the invention further include a drilling rig capable of being used offshore comprising:

a. a drilling rig comprising a deck, wherein the drilling rig is selected from the group consisting of a Compliant Tower, a Deep Draft Caisson Vessel (SPAR), a Tension Leg Platform, a Temporary Tension Leg Platform, a Semi Submersible rig and a Mono Hall Ship;
b. a cantilever adapted to be moveable in a first direction and a second direction for offshore use;
c. a multi purpose tower fixably attached to the cantilever;
d. a supporting cart disposed between the cantilever and the deck;
e. at least four friction reducing devices secured to the supporting cart.

The friction reducing devices can be plates. For example, the plates can include an aluminum bronze alloy. Alternatively, the friction reducing devices can include a combination of plates formed from a material different from the cantilever and the drilling rig and hydrostatic bearings.

The drilling rig can further include a blowout preventor (BOP), a shaker and a centrifuge.

In one embodiment, the cantilever and multi purpose tower have an L-shape.

While this invention has been described with emphasis on the preferred embodiments, it should be understood that within the scope of the appended claims, the invention might be practiced other than as specifically described herein.

What is claimed is:

1. A drilling rig capable of being used offshore comprising:

a. a cantilever, which is mounted for offshore use so as to be moveable in a first direction and a second direction with the cantilever projecting outside the drilling rig;
b. a multi purpose tower is fixedly attached to the cantilever, wherein the multi purpose tower comprises a mast disposed on a top side of the multi purpose tower provided with cable blocks fixedly connected to the mast and a gripper provided on a bottom side of the multi purpose tower, a trolley movably fixed on the mast, a hoist, a hoisting cable attached to the hoist and a winch, the hoisting cable being guided over the cable blocks, and wherein the trolley is moveable relative to the mast with the aid of the hoist; and
c. at least two friction reducing devices attached to a supporting cart, which are slidable with the supporting cart relative to the drilling rig and relative to the cantilever.

2. The drilling rig of claim 1, wherein the cantilever is slidable over the top side on at least two plates.

3. The drilling rig of claim 2, wherein the supporting cart further comprises at least two cylinders mounted thereto for moving the cantilever over the drilling rig.

4. The drilling rig of claim 3, wherein the at least two cylinders are hydraulic.

5. The drilling rig of claim 2, wherein the at least two plates are secured to the supporting cart.

6. The drilling rig of claim 5, wherein the at least two plates comprise a material different from the supporting cart and the drilling rig.

7. The drilling rig of claim 1, wherein the multi purpose tower is non-removably secured to the cantilever.

8. The drilling rig of claim 1, wherein the drilling rig is selected from the group consisting of a compliant tower, a deep draft caisson vessel, a tension leg platform. temporary tension leg platform. a semi submersible rig, and mono hull ship.

9. The drilling rig of claim 1, wherein the at least two friction reducing devices comprise hydrostatic bearings.

10. The drilling rig of claim 1 further comprising two push pull units mounted on the supporting cart for moving the cantilever on the drilling rig.

11. The drilling rig of claim 1, wherein the cantilever and multi purpose tower are of one-piece construction.

12. The drilling rig of claim 1, wherein at least a first setback and a second setback are placed beside the multi purpose tower and at least a first piperacker and a second piperacker are placed beside the multi purpose tower.

13. A drilling rig capable of being used offshore comprising:

a. a drilling rig comprising a central axis and a cantilever, which is mounted on a rotating ring adapted to rotate in multiple directions on the drilling rig;
b. a multi purpose tower fixably mounted on the cantilever, wherein the rotating ring enables the multi purpose tower to be rotated approximately 90 degrees relative to the central axis on the drilling rig, wherein the multi purpose tower comprises a mast disposed on a top side of the multi purpose tower provided with cable blocks fixedly connected to the mast and a gripper provided on a bottom side of the multi purpose tower, a trolley movably fixed on the mast, a hoist, a hoisting cable attached to the hoist and a winch, the hoisting cable being guided over the cable blocks, and wherein the trolley is moveable relative to the mast with the aid of the hoist; and c. at least two friction reducing devices secured to a supporting cart, which are slidable with the supporting cart relative to the drilling rig and relative to the cantilever.

14. The drilling rig of claim 13, wherein the friction reducing devices comprise at least two plates.

15. The drilling rig of claim 14, wherein the at least two plates comprise a material different from the supporting cart and the drilling rig.

16. The drilling rig of claim 13, wherein the cantilever further comprises at least two cylinders mounted thereto for moving the cantilever over the drilling rig.

17. The drilling rig of claim 16, wherein the cylinders are hydraulic.

18. The drilling rig of claim 13, wherein the multi purpose tower is non-removably secured to the cantilever.

19. The drilling rig of claim 13, wherein the cantilever is adapted to rotate more than about 360 degrees.

20. The drilling rig of claim 13, wherein said friction reducing devices comprise hydrostatic bearings.

21. The drilling rig of claim 13 further comprising two push pull Units mounted on the supporting cart for moving the cantilever on the drilling rig.

22. The drilling rig of claim 13, wherein the cantilever and multi purpose tower are of one-piece construction.

23. The drilling rig of claim 13, wherein the drilling rig is selected from the group consisting of a compliant tower, a deep draft caisson vessel a tension leg platform, temporary tension leg platform a semi-submersible rig and a mono hull ship.

24. The drilling rig of claim 13, wherein at least a first setback and a second setback are placed beside the multi purpose tower and at least a first piperacker and a second piperacker are placed beside the multi purpose tower.

25. A method for installing drilling equipment on a sub-sea well and drilling the well comprising a. placing a drilling rig with drilling equipment, a cantilever and multi purpose tower near a sub-sea well comprising a wellhead, wherein the multi purpose tower comprises a mast disposed on a top side of the multi purpose tower provided with cable blocks fixedly connected to the mast and a gripper provided on a bottom side of the multi purpose tower, a trolley movably fixed on the mast, a hoist, a hoisting cable attached to the hoist and a winch, the hoisting cable being guided over the cable blocks, and wherein the trolley is moveable relative to the mast with the aid of the hoist;

b. orienting the cantilever above the wellhead using rotational and translational movement;

c. picking up drilling equipment from the drilling rig using the multi purpose toWer;

d. placing the drilling equipment on the sub-sea well;

e. connecting the drilling equipment to the sub-sea well; and drilling the well.

26. A method for decommissioning a sub-sea well comprising:

a. placing a drilling rig with drilling equipment, a cantilever and multi purpose tower near a sub-sea well comprising a welihead, wherein the multi purpose tower comprises a mast disposed on a top side of the multi purpose tower provided with cable blocks fixedly connected to the mast and a gripper provided on a bottom side of the multi purpose tower, a trolley movably fixed on the mast, a hoist, a hoisting cable attached to the hoist and a winch, the hoisting cable being guided over the cable blocks, and wherein the trolley is moveable relative to the mast with the aid of the hoist;

b. orienting the cantilever above the wellhead using rotational and translational movement;

c. disconnecting the drilling equipment from the sub-sea well;

d. picking up the drilling equipment using the multi purpose tower; and e. placing the drilling equipment on the drilling rig.

27. A drilling rig capable of being used offshore comprising:

a. a drilling rig comprising a deck, wherein the drilling rig is selected from the group consisting of a compliant tower. a deep draft caisson vessel, a tension leg platform. temporary tension leg platform. a semi submersible rig, and mono hull ship:

b. a projecting cantilever adapted to be moveable in a first direction and a second direction for offshore use;

c. a multi purpose tower fixably attached to the proiecting cantilever and movable by the proiceting cantilever to a position which projects beyond the deck;

d. a rotatable supporting cart disposed between the projecting cantil ever and the deck;

e. at least four friction reducing devices secured to the supporting cart.

28. The drilling rig of claim 27 further comprising a blowout preventor a shaker and a centrifuge.

29. The drilling rig of claim 27, wherein cantilever and multi purpose tower have an L-shape.

30. A drilling rig capable of being used offshore comprising:

a. a drilling rig comprising a deck, wherein the drilling rig is selected from the group consisting of a compliant tower, a deep draft caisson vessel, a tension leg platform. temporary tension leg platform, a semi submersible rig, and mono hull ship;

b. a cantilever adapted to be moveable in a first direction and a second direction for offshore use;

c. a multi purpose tower fixably attached to the cantilever;

d. a supporting cart disposed between the cantilever and the deck; and e. at least four friction reducing devices secured to the supporting cart, wherein the friction reducing devices comprise plates.

31. The drilling rig of claim 30, wherein the plates comprise an aluminum bronze alloy.

32. The drilling rig of claim 30, wherein the friction reducing devices comprise a combination of plates comprising a material different from the cantilever and the drilling rig and hydrostatic bearings.

* * * * *